US008783916B2

(12) United States Patent
Tyson et al.

(10) Patent No.: US 8,783,916 B2
(45) Date of Patent: Jul. 22, 2014

(54) STEPLIGHT

(75) Inventors: Glenn M. Tyson, La Crescenta, CA (US); Michael P. Leonhardt, Castaic, CA (US); Daniel F. Cunado, Thousand Oaks, CA (US)

(73) Assignee: U.S.T.E. Inc., Simi Valley, CA (US)

( * ) Notice: Subject to any disclaimer, the term of this patent is extended or adjusted under 35 U.S.C. 154(b) by 194 days.

(21) Appl. No.: 13/546,264

(22) Filed: Jul. 11, 2012

(65) Prior Publication Data

US 2014/0016311 A1 Jan. 16, 2014

(51) Int. Cl.
*F21S 8/02* (2006.01)
*F21V 13/04* (2006.01)

(52) U.S. Cl.
CPC *F21S 8/022* (2013.01); *F21V 13/04* (2013.01)
USPC ..... 362/366; 362/146; 362/147

(58) Field of Classification Search
CPC ..... F21V 13/04; F21V 13/06; F21V 29/2206; F21S 8/022
USPC ..... 362/146, 147, 222, 217.05, 217.1, 362/249.02, 366
See application file for complete search history.

(56) References Cited

U.S. PATENT DOCUMENTS

| | | | | | |
|---|---|---|---|---|---|
| 934,122 | A * | 9/1909 | Woodman | ..... | 362/146 |
| 3,753,217 | A * | 8/1973 | Willfurth | ..... | 362/146 |
| 4,425,601 | A * | 1/1984 | Donahue | ..... | 362/146 |
| 2005/0024856 | A1 * | 2/2005 | Helenowski | ..... | 362/147 |

* cited by examiner

*Primary Examiner* — David V Bruce
(74) *Attorney, Agent, or Firm* — Novak Druce Connolly Bove + Quigg LLP

(57) ABSTRACT

A recessed light includes an enclosure with a cavity, an opening into the cavity and a mounting surface about the periphery of the opening. An intermediate light assembly including a peripheral frame and a lamp is mounted on the mounting surface of the enclosure. The peripheral frame includes a main frame and extension rings which can be stacked to extend the lamp away from the cavity. The lamp has an array of light emitting diodes on a substrate which is affixed to and thermally integral with a pivotally mounted reflector mounted to the peripheral frame. The reflector provides cooling fins for the array of light emitting diodes. A lens associated with a lens frame is attached to the intermediate lamp assembly.

15 Claims, 4 Drawing Sheets

STEPLIGHT

BACKGROUND OF THE INVENTION

The field of the present invention is recessed light fixtures.

Commercial recessed steplights are a widely used product category used for the illumination of walkways, stairways and pedestrian ingress and egress areas at the entrances and exits of buildings, among other applications. Their low mounting (generally within 18 inches of grade) combined with recessed positioning, typically in hardscape, makes them a preferred selection of lighting fixture types for illumination of pedestrian areas. Despite the popularity of steplights, many challenges await those who wish to utilize this product category within their site.

Proper placement of recessed steplights generally is left to the installer. The depth of placement relative to the finished wall surface is from important to critical for esthetics and functional integrity. Installation instructions frequently indicate the warranty against water entry will be voided if the enclosure is not placed properly relative to the finished wall surface according to instructions.

The challenges with precise positioning are numerous. First, many walls are not smooth. Determining where the "finished surface" will be while the wall is in the framing stage (as in drywall construction) or in the pour phase (as in concrete) is difficult. Second, there are many finishes that require a fitting up to the enclosure as in faux brick, which can vary in thickness. Once the finish is applied, many traditional steplights appear to be recessed too deeply or have no provision to cover the edge produced by the finishing elements. Third, if the sealing cover is required to engage the enclosure about its perimeter, any overlap of the finishing materials impedes the sealing cover's ability to seal the enclosure. Thus water can enter into the enclosure and cause destruction of the steplight. Fourth, remedial aiming of an improperly placed lamp is often not available.

SUMMARY OF THE INVENTION

The present invention is directed to recess lighting.

In a first separate aspect of the present invention, a recessed light has an enclosure with a cavity, an opening into the cavity and a mounting surface about the periphery of the opening. An intermediate lamp assembly includes a peripheral frame and a lamp. The lamp has a light source, a reflector and a power source for the light source. The peripheral frame supports the lamp and engages the mounting surface. A lens assembly having a lens frame with a lens engages the other side of the peripheral frame. Gaskets seal each side of the peripheral frame of the intermediate lamp assembly. The peripheral frame of the intermediate lamp assembly, standing between the enclosure and the lens frame assembly and mounting the lamp therein, overcomes sealing and placement issues associated with recessed lights built into outdoor hardscape such as concrete walls. A reduced perimeter of the intermediate lamp assembly may further overcome placement issues if the enclosure is too deeply placed.

In a second separate aspect of the present invention, a recessed light has an enclosure with a cavity, an opening into the cavity and a mounting surface about the periphery of the opening. An intermediate lamp assembly includes a peripheral frame and a lamp. The peripheral frame has a main frame and at least one extension ring. The lamp has a light source, a reflector and a power source for the light source. The peripheral frame supports the lamp and engages the mounting surface. A lens assembly having a lens frame with a lens engages the other side of the peripheral frame. Gaskets seal each side of the peripheral frame of the intermediate lamp assembly. Gaskets further seal between the main frame and the adjacent at least one extension ring and between any mutually adjacent extension rings. In addition to overcoming sealing and placement issues associated with recessed lights built into outdoor hardscape such as concrete walls, the extension rings can adjust placement of the lens assembly and intermediate lamp assembly relative to the surface of the hardscape.

In a third separate aspect of the present invention, a recessed light has an enclosure with a cavity, an opening into the cavity and a mounting surface about the periphery of the opening. An intermediate lamp assembly includes a peripheral frame and a lamp. The lamp has a light source, a reflector and a power source for the light source. The light source includes an array of light emitting diodes on a substrate affixed to and thermally integral with the reflector. LED cooling is accommodated through the reflector with the substrate of the light emitting diodes thermally integral with the reflector. Fins may be used to enhance this cooling. The reflector with the light source thereon advantageously can be pivotally mounted in the peripheral frame to allow hot aiming. Displacement of the power source, while remaining with the intermediate lamp assembly, can also enhance temperature control.

In a fourth separate aspect of the present invention, any of the foregoing aspects may be combined to afford greater advantage.

Accordingly, it is an object of the present invention to provide an improved and accommodating recessed light. Other and further objects and advantages will appear thereinafter.

DETAILED DESCRIPTION OF THE PREFERRED EMBODIMENT

Figure 1:
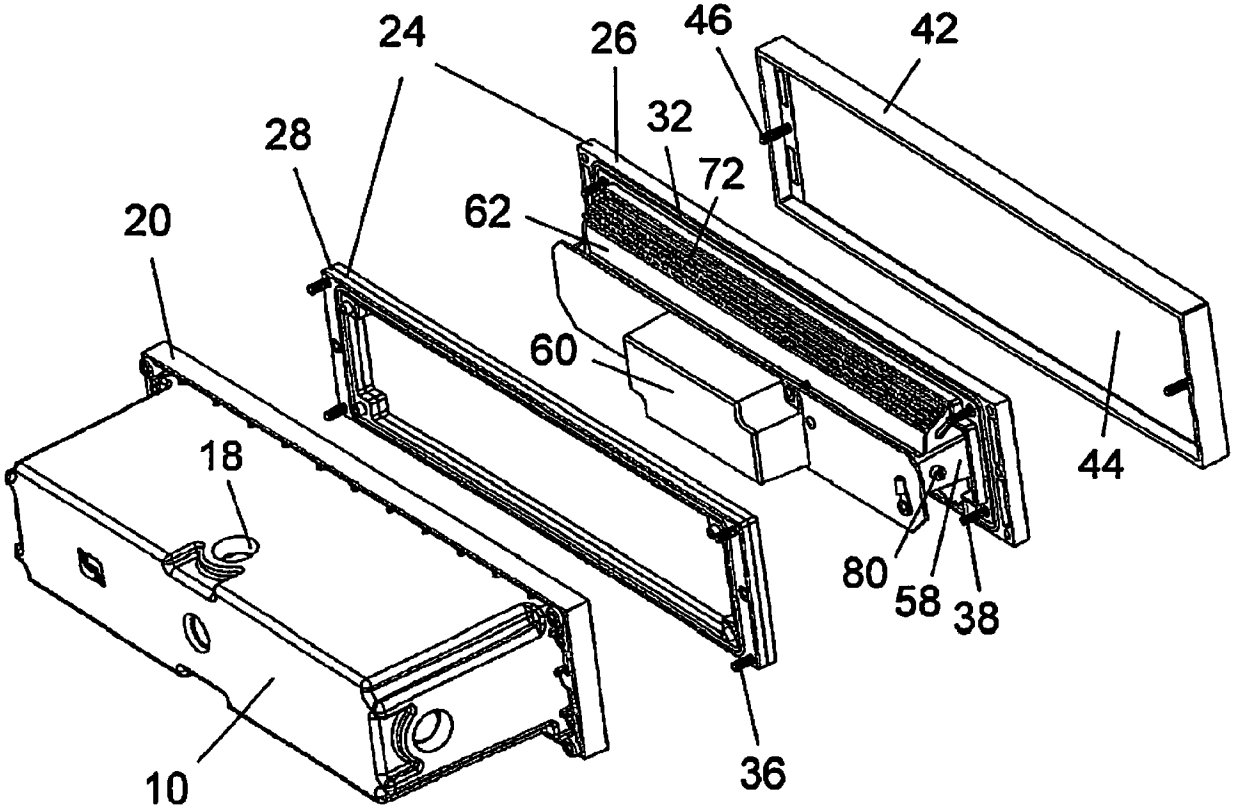
FIG. 1 is an exploded assembly view of a recessed light.
Figure 2:
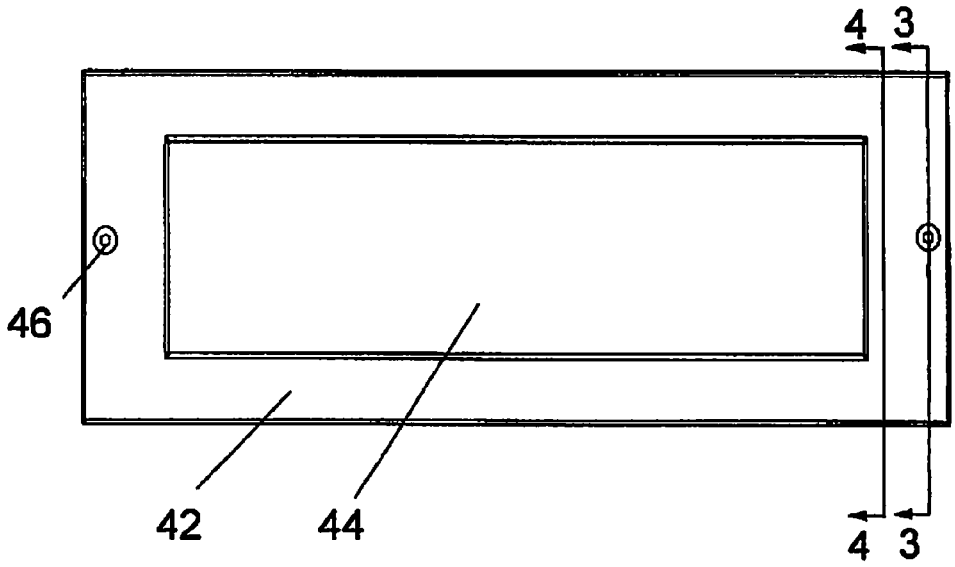
FIG. 2 is a front view of the recessed light of FIG. 1.
Figure 4:
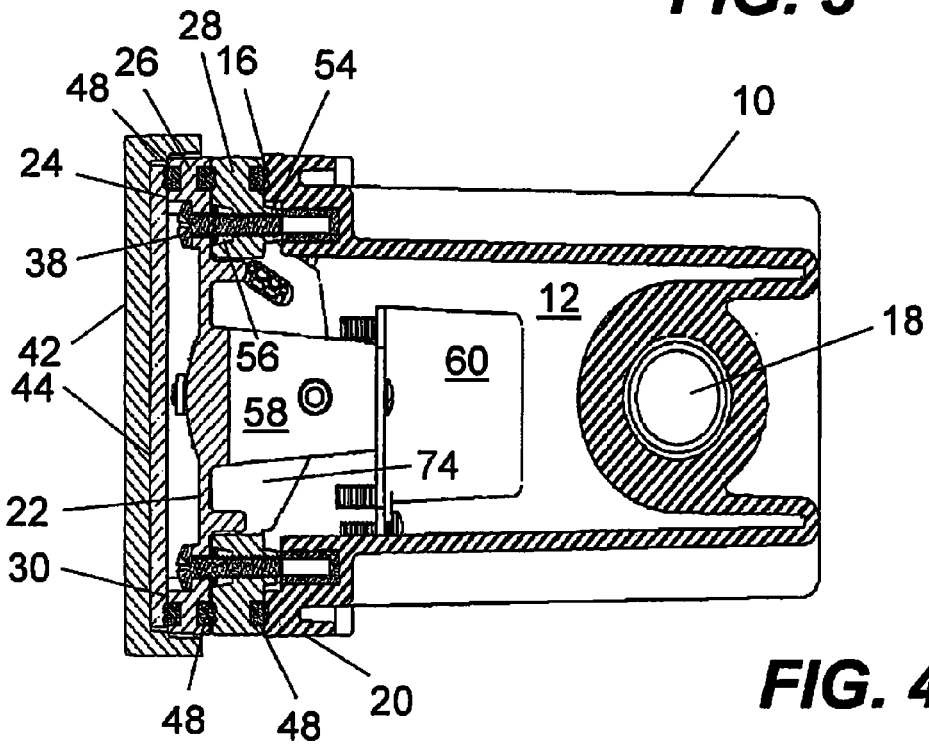
FIG. 4 is a cross-sectional view of the recessed light taken along lines 4-4 of FIG. 2.
Figure 5:
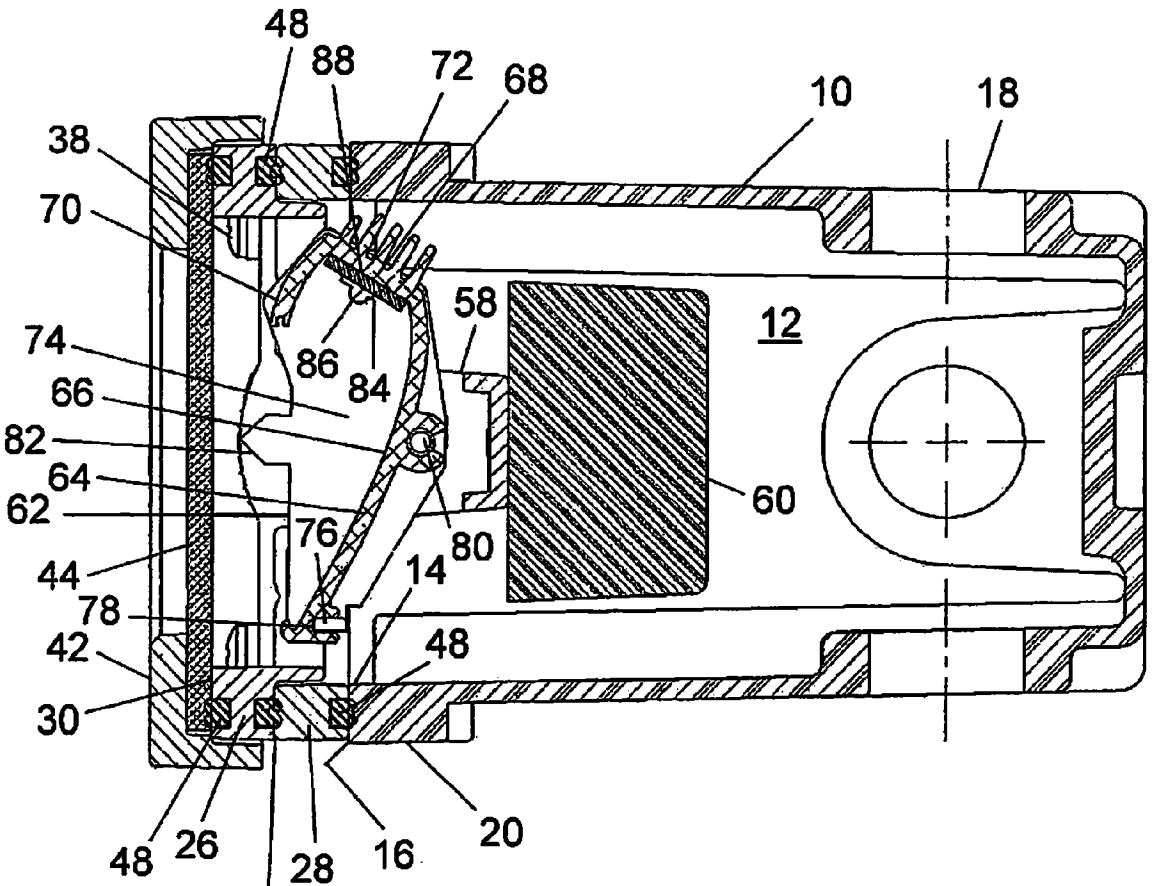
FIG. 5 is a cross-sectional schematic of the assembled parts taken through a central vertical plane of the recessed light.

Turning in detail to the drawings, FIG. 1 illustrates a recessed light which includes a recess enclosure 10. The enclosure 10 includes a cavity 12 as seen in FIGS. 4 & 5. The cavity 12 has an opening 14 with a mounting surface 16 about the periphery of the opening 14. The mounting surface 16 forms a plane facing away from the cavity 12. The enclosure 10 is sealed but for the opening 14 with knockouts 18 available for sealed entry of power. Each corner of the enclosure 10 is relieved with a concave radius to accommodate attaching bolts. The recess enclosure 10 may be of structural plastic and preferably comes with removable vertical stays extending into the cavity 12 to resist concrete loads before the concrete of the surrounding hardscape sets.

The recess enclosure 10 has a rectangular frame 20 about the opening 14 and defining the mounting surface 16. This frame 20 is intended to be cast into the concrete hardscape with the mounting surface 16 flush with the surface of the rough wall which may or may not receive further finish layers.

An intermediate lamp assembly 22 is mounted to the mounting surface 16 of the recess enclosure 10. The intermediate lamp assembly 22 is illustrated in the embodiment of the figures to include a peripheral frame 24 which is shown in the embodiment depicted to have a main frame 26 and an optional extension ring 28. A feature of this peripheral frame 24 is the accommodation of mis-installed recess enclosures 10. The main frame 26 may stand alone, include the single extension ring 28 or include multiple extension rings 28 depending on the placement of the recess enclosure 10 in the hardscape and the thickness of finish material from which the recessed light extends. The peripheral frame 24, as may stand alone as the main frame 26 or be composed of the main frame 26 and one or more extension rings 28, defines an outer surface perimeter which is smaller than the perimeter of the rectangular frame 20 to insure that, even if the recess enclosure 10 is deeply positioned in the wall, the peripheral frame 24 will seal the recess enclosure 10 and provide proper positioning of the intermediate lamp assembly 22 relative to the mounting surface 16. The stacking of extension rings 28 has exhibited sufficient flexibility of adjustment with each ring 28 at a thickness of ⅜". As many as three extension rings 28 may be employed before the mis-installation of the recess enclosure 10 should itself be corrected.

The main frame 26 has a first side 30 facing away from the cavity 12. A second mounting side 32 of the main frame 26 faces the cavity 12. The extension ring 28 has a common perimeter with the main frame 26. A first side of the extension ring 28 faces the mounting surface 16 and can be assembled therewith in sealing engagement. The other side of the extension ring 28 faces the mounting side 32 on the main frame 26 to form a sealing engagement.

Fasteners, in the preferred embodiment employing bolts 36, extend through the extreme corners of the extension ring 28 to engage threaded holes in the rectangular frame 20. These threaded holes are located outwardly of the main body of the recess enclosure 10. The bolts 36 vary in length depending upon the number of extension rings 28 used. The main frame 26 also has fasteners defined by bolts 38 extending there through. These bolts 38 engage either threaded holes in the rectangular frame 20 if no extension ring 28 is used or threaded holes through the most adjacent extension ring 28 only, if one or more such rings 28 are used. These bolts 38 are inwardly placed relative to the bolts 36 and are of the same length regardless of the number of extension rings 28 used. If tightening of the bolts 36 is desired with the main frame 26 assembled with the extension ring(s) 28, the bolts 36 can be accessed to that end through holes 40 located in the main frame 26.

The main frame 26 defines a lens mounting on the side facing away from the cavity 12. A lens assembly including a lens frame 42 and a lens 44 in the lens frame 42 is received by the outwardly facing mounting surface of the main frame 26. Fasteners, shown as bolts 46 in the preferred embodiment, at either end of the lens frame 42 define frame fasteners which extend through the main frame 26 at each end thereof. The bolts 46 extend to engage threaded holes in the rectangular frame 20 to capture the lens 44 when no extension rings are needed. When one or more extension rings 28 are used, the bolts 46 extend to engage threaded holes in the most adjacent extension ring 28 only. Thus, the lens frame 42 is held against the main frame 26 by bolts 46 attaching through the main frame 26 to the next adjacent element, either an extension ring 28 or the rectangular frame 20. The main frame 26 is also affixed to the most adjacent extension ring 28 by bolts 38 or to the rectangular frame 20 when one or more extension rings is not used. Finally, the extension ring or rings 28 are bolted to the rectangular frame 20 of the recess enclosure 10. In this way only a variety of sizes of bolts 36 are required depending upon the number of extension rings 28 to be employed in a stacked arrangement. Again, it is preferable if all of the at least one extension ring 28 and the main frame 26 have a common perimeter, which perimeter is smaller than the maximum perimeter of the rectangular frame 20 of the recess enclosure 10.

Figure 6:
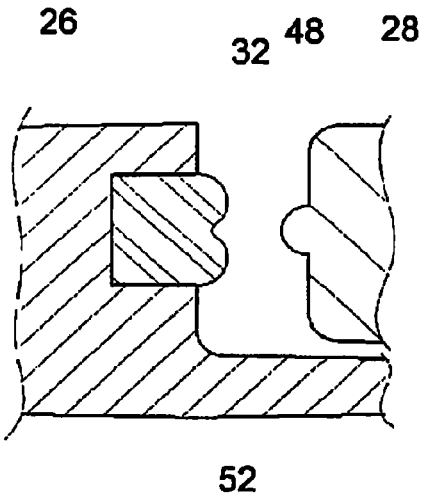
FIG. 6 is a detail cross-sectional view of a sealed joint prior to assembly.
Figure 7:
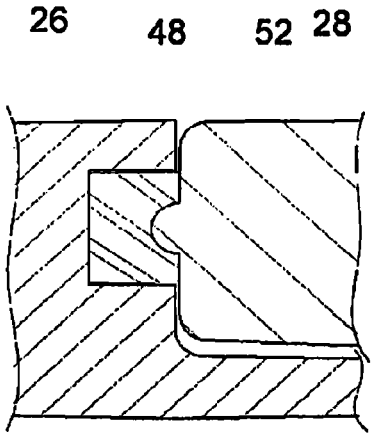
FIG. 7 is a detail cross-sectional view of a sealed joint assembled.
Figure 3:
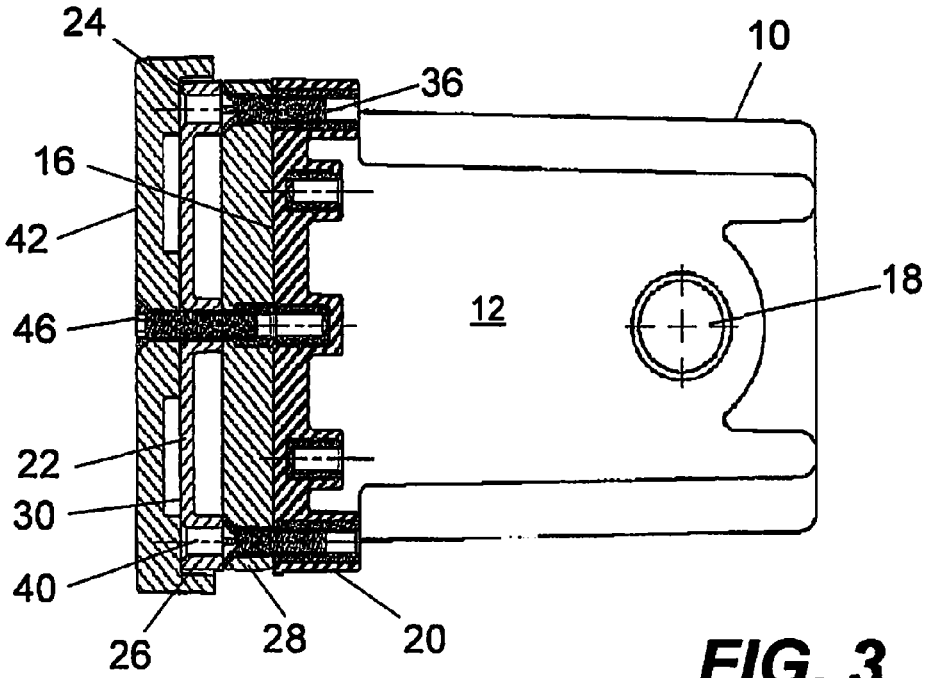
FIG. 3 is a cross-sectional view of the recessed light taken along lines 3-3 of FIG. 2.

Gaskets 48 form seals between the stacked components from the mounting surface 16 of the recess enclosure 10 to the lens 44. The gaskets 48 have a double raised dome profile in cross section to securely seal the components when drawn together by the bolts 36, 38, 46. The main frame 26 has opposed gasket grooves to receive gaskets 48 facing in opposite directions. The outwardly facing gasket groove is shown to address the lens 44. The gasket groove facing the extension ring 28 receives a rounded rib 52 as best illustrated in FIGS. 6 and 7. This arrangement facilitates the appropriate positioning of the components together. The gasket groove on the extension ring 28 is uniform to all such extension rings 28 to seal against the mounting surface 16 of the recess enclosure 10.

To assist with alignment of stacked extension rings 28, each extension ring 28 includes a conical boss 54 on the mounting surface facing the recess enclosure 10 and a conical cavity 56 on the opposite surface. The conical bosses 54 and cavities 56 are located about the bolts 38. Thus, the peripheral frame 24 including the main frame 26 and one or more extension rings 28 are located and sealed between the lens 44 and the mounting surface 16 of the recess enclosure 10. The distance between the mounting surface 16 of the recess enclosure 10 and the lens frame 42 is variable depending on the size of the peripheral frame 24 made up from the main frame 26 and a selected number of the extension rings 28.

The main frame 26 further includes an integral U-shaped mount 58 which extends inwardly into the cavity 12. The mount provides a point of attachment for a power source 60. This power source 60 is displaced from the forward portion of the assembly, avoiding heat from the lamp components. The integral mount 58 also conveniently provides a pivot mounting within the U-shaped structure.

The intermediate lamp assembly 22 further includes a lamp mounted within the periphery of the main frame 26. The lamp includes a reflector 62 which is pivotally mounted to the integral mount 58 about a horizontal axis to allow hot aiming of the lamp. The reflector 62 is a thermally-conductive extrusion 64. The extrusion 64 is formed to create an arcuate reflective portion 66, a light source mounting portion 68 and a shade portion 70. The light source mounting portion 68 includes cooling fins 72 on the side opposite the attachment for the light source. Plates 74 are located at either end of the reflector 62 and pivot therewith. The plates each include a tab 76 to be received in a notch 78 adjacent the bottom of the reflector 62. Pivots 80 from the integral mount 58 are received through the plate 74 by the reflector as seen in FIG. 5. An indicator 82 may be associated with a scale to show the angle of adjustment on the positionable reflector 62.

The light source 84 includes light emitting diodes 86 in an array on a substrate 88. The substrate 88 is affixed to the reflector 62 at the light source mounting portion 68. The substrate 88 and the reflector 62 are held in intimate contact to be thermally integral for heat transfer with minimal resistance. Thus, heat generated by the light source 84 is transferred through the reflector 62 to the cooling fins 72 as well as spread through the other portions of the reflector 62 to radiate heat away from the source. The power source 60 for the light emitting diodes 86 is an LED driver.

In operation, the recess enclosure 10 is positioned and embedded in the hardscape with the mounting surface 16, depending on the skill and attention of the installer, more or less in a plane with the rough surface of the structure receiving the recess enclosure 10. With the final surface material then added, the recessed light can be assembled. An intermediate lamp assembly 22 is constructed. An appropriate number of extension rings 28 are assembled on the mounting surface 16 of the recess enclosure 10 and retained by bolts 36. The bolts 36 are tightened to bring the associated gaskets 48 into sealing engagement with one another and with the mounting surface 16. The main frame 26 is assembled with the power source 60 and the reflector 62 preassembled with the light source 84. The pivots 80 rotatably retain the reflector 62. Wiring (not shown) is installed in a conventional manner. The intermediate lamp assembly 22 is completed by alignment with the most adjacent extension ring 28 and fastened together by bolts 38. Again, tightening of the bolts 38 brings the associated gasket 48 into sealing engagement with the most adjacent extension ring 28. The reflector 62 may then be adjusted about the horizontal pivot axis to direct light as desired. A conventional set screw or friction mechanism may be employed to retain the angle of the reflector 62. Finally, the lens frame 42 retaining the lens 44 is placed against the intermediate lamp assembly 22 and bolted thereto by the bolts 46. The associated gasket 48 seals against the lens 44 to complete the assembly.

Accordingly, an improved and accommodating recessed steplight is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A recessed light comprising a recess enclosure including a cavity having an opening and a mounting surface about the periphery of the opening facing away from the cavity;

a lens assembly including a lens frame and a lens in the lens frame;

an intermediate lamp assembly including a peripheral frame and a lamp, the peripheral frame having a first side defining a lens assembly mounting and a second side defining a recess enclosure mounting, the lamp having a light source, a reflector and a power source for the light source, the peripheral frame supporting the lamp, the intermediate lamp assembly being between and engaged with the lens assembly and the mounting surface;

gaskets forming seals between the first side and the lens assembly and between the mounting surface and the second side.

2. The recessed light of claim 1, wherein the recess enclosure has a maximum perimeter adjacent the mounting surface and the peripheral frame has a perimeter which is smaller than the maximum perimeter of the recess enclosure.

3. The recessed light of claim 1, wherein the reflector is pivotally mounted within the peripheral frame.

4. The recessed light of claim 3, wherein the light source is affixed to pivot with the reflector.

5. The recessed light of claim 1, wherein the light source is light emitting diodes and the power source is an LED driver, the peripheral frame having an integral mount extending into the cavity, pivotally mounting the reflector and rigidly mounting the LED driver.

6. A recessed light comprising a recess enclosure including a cavity having an opening and a mounting surface about the periphery of the opening facing away from the cavity;

a lens assembly including a lens frame and a lens in the lens frame;

an intermediate lamp assembly including a peripheral frame and a lamp, the peripheral frame having a main frame, at least one extension ring, a first side defining a lens assembly mounting and a second side defining a recess enclosure mounting, each of the main frame and the at least one extension ring having an outer surface defining a common perimeter, the first side being on the main frame and the second side being on the at least one extension ring most distant from the main frame, the lamp having a light source, a reflector and a power source for the light source, the main frame supporting the lamp, the intermediate lamp assembly being between and engaged with the lens assembly and the mounting surface;

gaskets forming seals between the first side and the lens assembly and between the mounting surface and the second side, the gaskets further forming seals between the main frame and the adjacent at least one extension ring and between any mutually adjacent extension rings.

7. The recessed light of claim 6, wherein the lens frame includes lens frame fasteners extending through the main frame to engage the most adjacent at least one extension ring only, the intermediate lamp assembly further includes extension ring fasteners engaging the main frame with the most adjacent at least one extension ring only and enclosure fasteners engaging all of the at least one extension ring with the recess enclosure.

8. The recessed light of claim 6, wherein there are multiple of the at least one extension ring in stacked arrangement, the main frame and the multiple extension rings each having identical gasket grooves facing toward the mounting surface.

9. The recessed light of claim 8, wherein the gaskets each include a concavity In cross section and the extension rings each have a ridge mating with the adjacent concavity.

10. A recessed light comprising a recess enclosure including a cavity having an opening and a mounting surface about the periphery of the opening facing away from the cavity;

a lens assembly including a lens frame and a lens in the lens frame;

an intermediate lamp assembly including a peripheral frame and a lamp, the peripheral frame having a first side defining a lens assembly mounting and a second side defining a recess enclosure mounting, the lamp having a light source, a reflector and a power source for the light source, the peripheral frame supporting the lamp, the light source being an array of light emitting diodes on a substrate affixed to and thermally integral with the reflector, the intermediate lamp assembly being between and engaged with the lens frame and the mounting surface;

gaskets forming seals between the first side and the lens assembly and between the mounting surface and the second side.

11. The recessed light of claim 10, wherein the reflector is pivotally mounted to the frame.

12. The recessed light of claim 10, wherein the reflector is a thermally conductive extrusion with cooling fins on one side, the substrate being thermally integral with the other side of the extrusion at the cooling fins.

13. The recessed light of claim 10, wherein the peripheral frame has an integral mount extending into the cavity, the reflector being pivotally mounted to the frame, the power source being an LED driver rigidly mounted to the integral mount displaced from the reflector in the cavity.

14. A recessed light comprising a recess enclosure including a cavity having an opening and a mounting surface about the periphery of the opening facing away from the cavity;

a lens assembly including a lens frame and a lens in the lens frame;

an intermediate lamp assembly including a peripheral frame and a lamp, the peripheral frame having a first side defining a lens assembly mounting, a second side defining a recess enclosure mounting and an integral mount extending into the cavity, the lamp having a light source, a reflector pivotally mounted to the frame and a power source for the light source, the peripheral frame supporting the lamp, the reflector being a thermally conductive extrusion with cooling fins on one side, the light source being an array of light emitting diodes on a substrate affixed to and thermally integral with the reflector at the cooling fins on the other side of the extrusion, the intermediate lamp assembly being between and engaged with the lens frame and the mounting surface;

gaskets forming seals between the first side and the lens assembly and between the mounting surface and the second side.

15. The recessed light of claim 14, wherein the power source is an LED driver rigidly mounted to the integral mount displaced from the reflector in the cavity.

* * * * *